US006231457B1

(12) United States Patent
Chen

(10) Patent No.: US 6,231,457 B1
(45) Date of Patent: May 15, 2001

(54) NODAL CONTROLLED KICK-POINT LIGHTWEIGHT GOLF CLUB SHAFT, CLUB AND METHOD

(76) Inventor: Ming T. Chen, 45 E. Herbert Ave., Salt Lake City, UT (US) 84111

( * ) Notice: Subject to any disclaimer, the term of this patent is extended or adjusted under 35 U.S.C. 154(b) by 0 days.

(21) Appl. No.: 09/268,921

(22) Filed: Mar. 16, 1999

Related U.S. Application Data

(63) Continuation-in-part of application No. 09/016,269, filed on Jan. 30, 1998, and a continuation-in-part of application No. 08/709,277, filed on Sep. 6, 1996, now abandoned.

(51) Int. Cl.[7] ..... A63B 53/10; A63B 53/12

(52) U.S. Cl. ..... 473/319; 473/305; 473/316

(58) Field of Search ..... 473/300, 301, 473/305, 308, 309, 310, 311, 316, 317, 318, 319, 320, 321, 322, 323, 292, 327, 328

(56) References Cited

U.S. PATENT DOCUMENTS 5,199,707 * 4/1993 Knox ..... 273/80
5,511,786 * 4/1996 Antonious ..... 473/327
5,569,098 * 10/1996 Klein ..... 473/300
5,688,188 * 11/1997 Chappell ..... 473/309
5,803,828 * 9/1998 Huang ..... 473/300
5,865,688 * 2/1999 Bae ..... 473/323
5,997,413 * 12/1999 Wood, IV ..... 473/327

* cited by examiner

*Primary Examiner*—Jeanette Chapman
*Assistant Examiner*—Sneh Varma
(74) *Attorney, Agent, or Firm*—Marcus G. Theodore

(57) ABSTRACT

A low center of gravity golf club shaft for attachment to a lightweight golf club head having a toe, heel, face, sole, and top made of titanium or similar density material comprising: a hollow tapered cone-like shaft with a smaller club end attached to the club head proximate the heel, and a handle end; the shaft made of graphite wrapped with uni-direction tape to form at least two nodes to selectively stiffen or allow the shaft to flex at pre-selected points along the shaft, and a handwrap tape of desired length wrapped around the handle end of the shaft to provide a handgrip.

13 Claims, 3 Drawing Sheets

NODAL CONTROLLED KICK-POINT LIGHTWEIGHT GOLF CLUB SHAFT, CLUB AND METHOD

RELATED APPLICATIONS

This application is a continuation-in-part application of the continuation-in-part application entitled "Lightweight Golf Club Shaft, Club and Method", U.S. Ser. No. 09/016,269 filed Jan. 30, 1998 of the originally filed application entitled "Golf Shaft, Club and Method", U.S. Ser. No. 08/709,277 filed Sep. 6, 1996, now abandoned.

BACKGROUND OF THE INVENTION

1. Field

This invention pertains to golf club shafts, golf clubs, and methods for producing them. More particularly, it pertains to a nodal controlled kick-point lightweight golf club shaft for attachment to a lightweight golf club head made of titanium or other lightweight materials of similar or lessor density, and a method to produce the same.

2. State of the Art

Numerous lightweight golf club shafts and golf clubs are known. Conventional golf club drivers have heads weighing approximately 200–210 grams. In comparison, the newer lightweight titanium golf club drivers have heads weighing approximately 180–190 grams and require a lighter weight golf club shaft to lower the center of gravity of the club to provide better swing balance. Present lightweight golf club shafts are made of hollow tapered steel, which weigh approximately 120 grams, or hollow tapered graphite, which weigh approximately 95 grams. Czeck, U.S. Pat. No. 4,157,181 is an example of a typical narrow diameter graphite fiber tapered shaft having a handle end onto which are slid solid pre-wrapped and capped one-piece handles weighing approximately 46 to 52 grams. Inouet et al, U.S. Pat. No. 3,998,458 is another example of a typical narrow diameter graphite fiber tapered shaft generally having a dimension of 6 to 9 mm in diameter at the tip portion, and a 14–17 mm in diameter at the shaft butt portion onto which a solid one piece handle is inserted thereon. These solid one piece handles act to shift the center of gravity of the club toward the handle end; thus giving an unbalanced feel which also does not concentrate the weight of the club in the club head, during the swing.

Also, the flex of present graphite shafts is not adjusted to match the club head striking characteristics. Traditional wood and club head designs prevented the shaft from being located closer to the sweetspot (the clubheads' center of gravity). Thus anything less than a dead center impact caused the shaft, especially early graphite shafts, to over-torque, causing directional problems and less-than-perfect feel. To counteract this, graphite shafts had to be designed with stronger, heavier materials. This produced a stiffer, less-responsive shaft and a decrease in distance and feel, particularly for off-center hits.

In addition, the clubhead was not matched to the shaft's flexing characteristics. The easiest way to design a solid feeling, more forgiving clubhead is to drop the center of gravity very close to the sole of the club. This increases the amount of backspin, causing the ball to climb higher. Although this is effective, the trade off was a loss of forward momentum and excessive shot trajectory. High, short shots became the trademark of the standard metal wood design.

Newer 55–60 gram hollow graphite shafts, the solid one piece handles are even more top heavy, and accentuate the unbalanced feel. There therefore remains a need for a new shaft, club, and handle design to control the shaft torque and flex and concentrate the weight of the club in the club head to provide an optimum pendulum striking effect. The invention described below, provides such an improvement and method for making the same.

SUMMARY OF THE INVENTION

The invention comprises a low center of gravity golf club shaft for attachment to a lightweight golf club heads having a toe, heel, face, sole, and top made of titanium or similar or lower density material. The one piece combination handle and shaft is hollow and tapered, with the smaller club attachment end having a diameter for attachment to the driver heads of approximately 8.5 mm, and of approximately 9.4 mm for attachment to iron heads. Preferably the shaft is made of graphite wrapped with filament embedded in a resin matrix, or uni-direction tape angle wound to selectively stiffen and build up tapered nodes to allow the shaft to flex at pre-selected points along the shaft. These nodes also impede club torque on a miss hit shot. The wound, reinforced, shaft weighs approximately 55 to 65 grams. The shaft is preferably hollow to reduce the handle weight, but could also be of solid construction. The thickneses of the hollow shaft walls are sufficient to provide rigidity to the shaft to maintain its integrity during use. However, the actual shaft wall thicknesses vary depending upon the strength of the graphite and filament windings or tapes employed.

In conventional shafts, the flexpoint or angle of bend of the shaft (commonly referred to as the kick point of the shaft) varies considerably, depending upon shaft length, types of materials, swing types, and swing speed. This in turn materially affects the angle the club head meets the ball affecting the club performance. For example, with a short iron, it is desirable for the shaft to have a lower kick point such that the club face of the iron strikes at a greater angle under the ball to provide higher trajectory, and backspin to the ball. For drivers, a shaft with a higher kick point is desired to hit the ball at less of an angle to provide a lower trajectory with increased distance. Thus, the loft and spin of the ball is varied by using different club heads. For example, an iron with a low center of gravity and increased height of the club face provides higher loft and more backspin. Conversely, the driver employs a lesser angled club face and an increased club head height to raise the center of gravity of the club head and provide more distance and less backspin when hit. Thus if the kick point of the shaft does not match the club head, the hitting characteristics of the shot may be materially affected.

Both drivers and iron heads may also have increased widths to provide a more forgiving club head, which is easier to play, if miss hit. However, conventional shafts do not resist shaft torque, if the club miss hits the ball causing loss of performance.

Thus, control of the shaft kick point and torque is imperative to optimize the performance of the club. The kick point of the improved shaft is controlled by at least two built up tapered nodes placed on the lower one half to one-third of the shaft toward the club head. These tapered nodes are separated sufficiently apart to allow the shaft to bend therebetween at the desired flex point. These tapered nodes are built-up and made of the same materials as the shaft, and control the flex point angle of shaft bend so that the shaft angle that the club head meets the ball corresponds to the desired club face angle for optimal performance. The kick point of the shaft is thus controlled by the shaft tapered thicknesses between the nodes, the angle of windings of the two built up tapered nodes, and the stiffness of the materials and windings employed.

In addition, a third tapered node just below the handle may be included to dampen vibration of the club head hitting the ball. This third node also acts to provide balance to the club.

The shaft club attachment ends are attached to the club head proximate the heel via a recessed ferrule affixed to the club attachment end. The ferrule covered club attachment end is then inserted within a socket in the top of a no neck golf club head, or the neck of a golf club head. Golf club irons have necks to vary the angle of the face. These golf club iron necks are normally covered by a hosel. In the improved embodiment, the hosel of the golf club iron is shortened and the hosel on the wood is eliminated in favor of the recessed cushioned minimal weight ferrule to further lower the center of gravity of the golf club. The ferrule covers the shaft club attachment end to reinforce the club attachment end to prevent splitting and breakage of the shaft proximate its point of attachment to the head or iron. This ferrule is matched to each club head's hand beveled, progressively tapered bore. This ferrule adds strength to the shaft club attachment end by sitting down inside the club socket or neck to provide a 360-degree cushion that moves with the normal flexing and twisting of the shaft. This continuous cushioning prevents damage with the inside of the socket or neck, avoiding the leading cause of breakage in graphite shafts.

The shaft handle end is similarly sized to a diameter of a conventional handle, approximately 22–25 mm in outside diameter of the grip. A handwrap tape weighing approximately 11 grams and made from a lightweight grip material, such as the synthetic leathers made by the Japan Kanebo Fabric Company for tennis wraps, may then be wrapped around the handle end of the shaft to provide a lightweight handgrip of minimal thickness and weight. To prevent the hollow shaft from filling with debris, a rubber or plastic cap weighing approximately 2 grams covers the handle end of the shaft. Alternatively, a conventional slide on handle may be used with the tri-nodal shaft, if desired.

The strength of titanium allows the club head to be designed with the shaft closer to the club head's center of gravity. The filament-wound lightweight shaft further lowers the golf club's center of gravity to provide a lighter more responsive club, while still reducing the amount of unwanted torque.

To provide better balance, performance, and forgiveness, an oversized titanium club head having an increased face height is employed to increase the playability of the ball. This increased face height moves the center of gravity upwards away from the sole of the club to provide a longer ball trajectory. By fine-tuning the distance between the center of mass of the club head and the face, the sweetspot of the club head is further expanded. This provides the greatest amount of correction on off-center hits, which requires a torque resistant shaft, without sacrificing overall performance.

In one preferred embodiment to provide an even lower center of gravity golf club, the golf club driver heads do not have a neck, but have the shaft inserted into a socket in the top of the club head at a point behind the club face such that the angle of attachment of the shaft to the club head is aligned to intersect the center of gravity of the club head as close as possible. For irons having a neck, the neck is reduced to the minimal size necessary to secure to the club attachment end of the shaft. This configuration provides optimal striking force as the club contacts the ball.

The low center of gravity golf club bi-nodal or tri-nodal shaft is then inserted in a socket in the top of the club head or the reduced neck iron via the recessed cushioned ferrule discussed above. Preferred ferrules are made of rubber, plastic, and other lightweight shock absorbing materials. Although this ferrule slightly protrudes out of the socket or neck depression, it not only reinforces the shaft club end at the point of attachment, but also further lowers the center of gravity by avoiding the necessity of employing a conventional ferrule.

This improved low center of gravity golf shaft provides a low center of gravity golf club when attached to a lightweight golf club head made of titanium or similar or lower density material having a toe, heel, face, sole, and socket in the top. However, it can also be used with conventional lightweight golf club heads having necks.

The preferred golf club embodiment has a club head face matched and attached with a hollow tapered tri-nodal shaft similar to that described above to provide the desired club face angle at the point of impact with the ball. The smaller club attachment end of the shaft is inserted within a socket in the top of the club head or neck, proximate the heel at a point behind the club face at an angle of attachment such that the shaft to the club head or iron is aligned at an angle to intersect the center of gravity of the club head.

The graphite tape wrapped built up bi or tri nodal shaft selectively stiffens the shaft to allow the shaft to flex at pre-selected point along the shaft to optimize the angle the club face strike the ball for optimal distance at a desired shot height.

A ferrule is attached to the bi-nodal or tri-nodal shaft club end before insertion into the socket into the club head to extend the shaft life. Handwrap tape of desired length is then wrapped and secured around the handle end of the shaft to provide a lightweight handgrip having a butt diameter as large as a conventional grip, but providing a shaft and handle less than half the weight of a conventional steel shaft. Additional layers of handwrap tape may be added for cushioning or increasing the size of the handle. A cap then covers the handle end of the shaft.

This improved low center of gravity club driver weighs approximately 245–260 grams vs. the 320–335 grams of a conventional club. The shaft weighs approximately 55–60 grams and the handle weighs approximately 13 grams. As the weight of the grip and shaft are reduced, more effective mass is moved behind the ball, giving longer drives. These lightweight shafts shift the golf club balance point as close to the head as possible. It thus provides a lightweight golf club, which concentrates the weight of the golf club in the golf club head to provide a hammerlike striking club for optimal force and distance. In addition, the shaft nodes adjust the shaft kick point to provide the desired angle the club head meets the ball for optimal performance and resist shaft torque.

DESCRIPTION OF THE ILLUSTRATED EMBODIMENTS

Figures 1, 2, 3, 4:
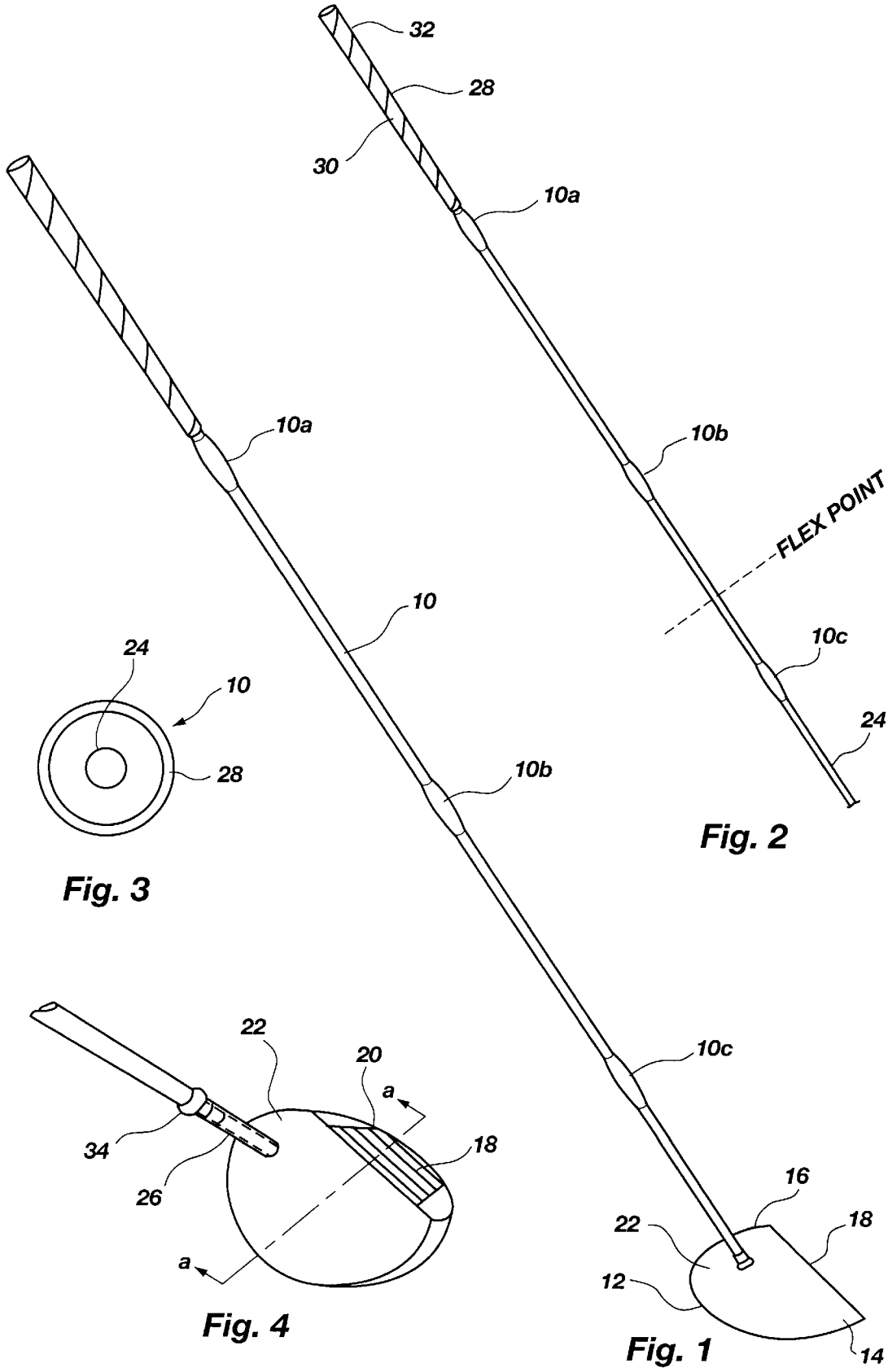
FIG. 1 illustrates a perspective view of one preferred embodiment of the golf club shaft attached to a golf club head.
FIG. 2 illustrates a perspective view of the handle of the golf club shaft.
FIG. 3 illustrates a cross sectional view of the golf club shaft.
FIG. 4 illustrates a perspective view of the golf club shaft shown in FIG. 1.

FIG. 1 illustrates a perspective view of the golf shaft 10 attached to a low center of gravity golf club head 12. The golf club head 12 has a toe 14, heel 16, face 18, sole 20, and top 22 made of titanium or lighter weight material of similar strength. The graphite shaft 10 is formed on a mandrel and is hollowed and tapered in a cone-like shape as shown in the shaft 10 cross section in FIG. 3. The shaft 10 is made of graphite filament wound or graphite tape rolled (not shown) to selectively stiffen and build up three tapered nodes 10*a*, 10*b*, and 10*c* shown in FIG. 2 to allow the shaft to flex at a pre-selected point along the shaft 10. The point the shaft flexes is adjusted upward or downward by moving nodes 10*b* and 10*c* along the lower half of the shaft 10 toward the club head 12 to adjust the angle the face of the lightweight club head strikes the ball to provide the optimal shot distance at the desired loft—i.e. a shorter shaft flex allows the club face to hit the ball at a greater angle providing more loft and less distance, whereas a longer shaft flex allows the club face the hit the ball at a lessor angle providing more distance and less loft. Thus, the shaft 10 is selectively stiffened by reducing the taper of the nodes 10*b* and 10*c* at the desired flex point (kick point) to provide the optimal flex for a given club head's performance characteristics. This is done by not only providing the minimal shaft thickness near the flex point, but by adjusting the angle of windings of the graphite filament of the shaft 10. As shown in FIG. 2, the angle of the windings is approximately 30 to 45 degrees to form the nodes 10*b* and 10*c* to reduce shaft torque. However, at the flex point, the angle of the windings is more 180 degrees in line with the cross sectional diameter of the shaft 10 to allow greater bending. Conversely, the lower node 10*c*, with its 30 to 45 degree windings, provides maximum torque resistance to resist twisting to aid in straightening out miss hit shots.

The shaft 10 has a smaller club attachment end 24 shown in FIG. 2 for attachment into the golf club head socket 26 shown in FIG. 4. A handle end 28 shown in FIG. 2 is wrapped with handwrap tape 30 of desired length to form the handgrip 32. Just below the handle is a third built up tapered node 10*a* to dampen and absorb any shock from the club striking a ball. This tapered node 10*a* is also tape wound at an angle to provide optimal torque resistance.

FIG. 4 illustrate a perspective view of the golf club shaft 10 shown in FIG. 1 attached to a low center of gravity golf club head 12 which does not have a neck. The club end 24 of the shaft 10 is inserted within a socket 26 in the top of the golf club head 12 at a point behind the club face 18 such that the angle of attachment of the shaft 10 to the club head 12 is aligned to pass near, or closer to, the center of gravity of the club head 12 shown as line a—a. Preferably the club face 18 of a driver club head 12 is constructed with a material and configuration, which minimizes ball spin.

The attachment end 24 of the shaft 10 is covered with a ferrule 34, which also acts as a cushioned hosel slightly protruding out of the socket 26; thereby eliminating the need for a separate hosel. This combination shaft 10 and golf club head 12 provides a lightweight low center of gravity golf club head near the sole 20 to optimize the striking force of the face 18 of the golf club head 12.

Figure 5:
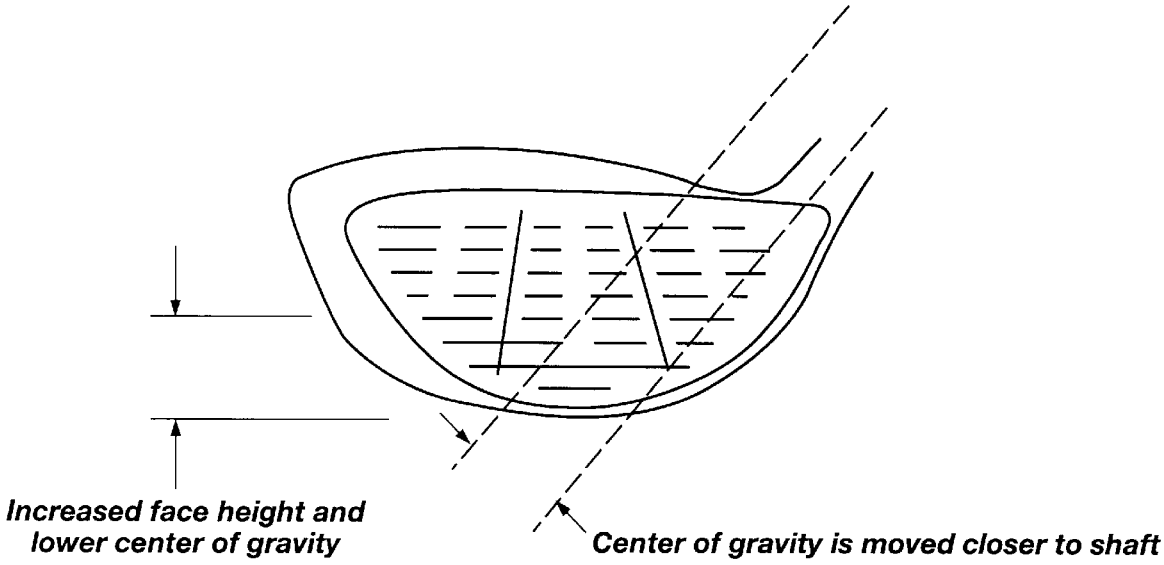
FIG. 5 illustrates a side view of a golf club head with a lower center of gravity.

FIG. 5 illustrates a side view of a golf club head 12, which as the height of the face increases, the center of gravity increases and moves closer to being in horizontal alignment with the end of the shaft 10 when the end of the shaft 10 is located at a lower height than the center of gravity. This elevated height of the face 18 also minimizes ball loft spin to lower the trajectory and provide more distance to a shot.

Figure 6:
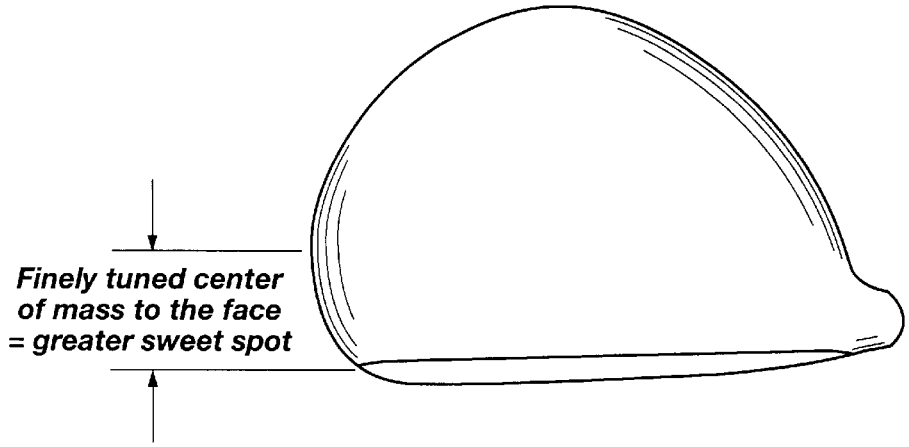
FIG. 6 illustrates a top view of the preferred golf club head shown in FIG. 5.

FIG. 6 illustrates a top view of the larger golf club head shown in FIG. 5 wherein the center of mass to the face is adjusted to provide a greater "sweet spot" to provide a more forgiving club.

Thus, the lightweight golf shaft 10 flex point is adjusted and fitted to a club head 12 having a center of gravity club moved closer to the angle of attachment of the shaft 10 to the club head 14 as shown in FIG. 5 to provide a hammerlike club with optimal shot performance.

Figure 7:
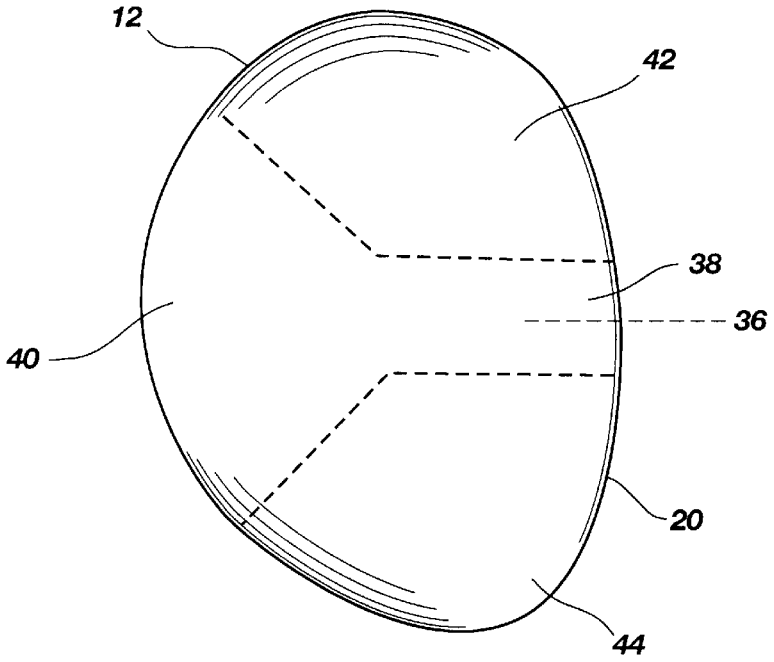
FIG. 7 illustrates a bottom view of a preferred golf club head.

FIG. 7 illustrates a bottom view of a preferred embodiment of a hollow lightweight titanium aerodynamically designed golf club head 12 weighing approximately 7 ounces. It is designed for use with a lightweight combination handle golf tri-nodal shaft 10. It has a sole 20 comprising a single piece defining a central air channel groove 36 leading into an angled fan shaped air exhaust flow channel 40, which is angled toward the sloped top 22 of the golf head 12. The golf head has a width of approximately 3.5 inches, a length of approximately 4.5 inches, and a thickness at the widest point of the slopped top 22 of approximately 2.0 inches. The central air channel groove 36 is located approximately normal the midpoint of the face 18 and extends approximately one half the width of the sole 20. This shallow rounded central air channel groove 36 has an inlet opening of approximately 0.5 inches and provides a support base for the club head 12 to provide the proper angle of attack especially for balls lying in the fairway. The concave flow groove 36 and exhaust flow channel 40 separate two angled winged flow segments 42, 44 of the sole 20, which are angled toward the sloped top 22 of the golf head 12 to further minimize aerodynamic resistance to this lightweight hollow titanium golf club head 12.

Figure 8:
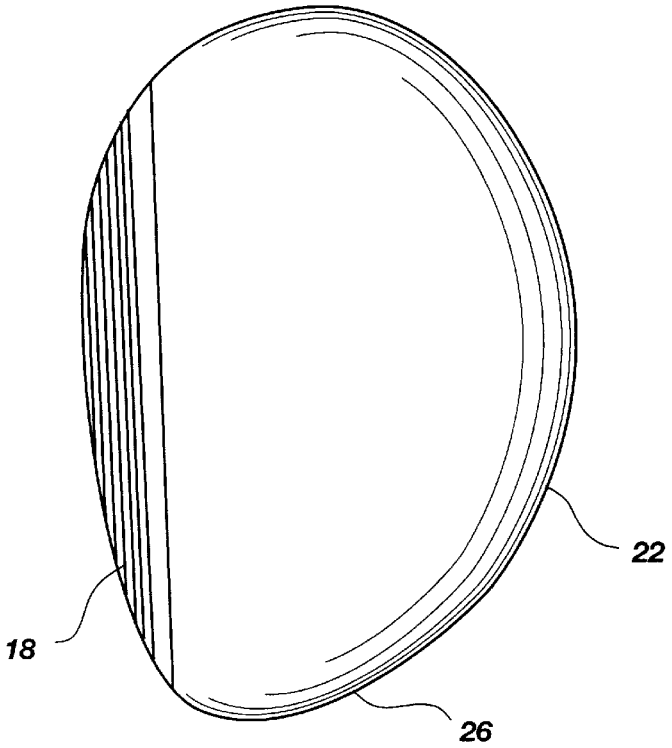
FIG. 8 illustrates a top view of the preferred golf club head shown in FIG. 7.

FIG. 8 illustrates a top view of the golf club head 12 shown in FIG. 7. The sloped top 22 of the golf club head 12 has a socket 26 into which the shaft attachment end 24 is inserted. By employing a neck-less socket 26, the shaft 10 may be attached behind the club face 18 and toward the center of the club head 12 to align the shaft close to the center of gravity of the club head 12 to optimize club performance.

Although this specification has made reference to the illustrated embodiments, it is not intended to restrict the scope of the appended claims. The claims themselves recited those features deemed essential to the invention.

I claim:

1. A low center of gravity golf club shaft for attachment to a golf club head or iron having a face and top comprising:

a. a tapered shaft with a smaller attachment club end attached to the club head, and a handle end having an outer diameter sized to fit and provide a desired sized grip for a user; the shaft made of filament wound or prepreg tape graphite built-up to form three separated tapered increased diameter nodes along the shaft:

i. a torque control node positioned near the club head to minimize torque caused by a miss-hit shot, ii. a kick-point control node located along the lower one half of the shaft toward the attachment club end to allow the shaft to flex at a pre-selected point between the torque control node and the kick-point control node to adjust the angle the club face strikes a golf ball to provide optimal shot distance at the desired loft, and minimize shaft torque, and iii. a vibration control node located proximate the handle to absorb and dampen vibration of the shaft when a ball is struck, and b. a handle, which does not materially increase the size or weight of the handle end of the shaft to provide a handgrip.

2. A low center of gravity golf club shaft according to claim 1, wherein the handle is a hand wrap tape of a thickness, which does not materially increase the size or weight of the handle end when wrapped with a desired length of tape around the handle end of the shaft to provide a handgrip, and a cap covering the handle end of the shaft.

3. A low center of gravity golf club shaft according to claim 1, wherein the golf club head has a neck into which the club attachment end is affixed.

4. A low center of gravity golf club shaft according to claim 3, wherein the club attachment end of the shaft is covered with a lightweight, cushioned, recessed ferrule and inserted within the socket.

5. A low center of gravity golf club shaft according to claim 3, wherein the neck of the club head is minimized and aligned such that the angle of attachment of the shaft to the club head is aligned to intersect as close as possible the center of gravity of the club head.

6. A low center of gravity golf club shaft according to claim 1, wherein the club attachment end of the shaft is attached to a golf club head with no neck by insertion within a socket defined by the top of the golf club head at a point behind the club face such that the angle of attachment of the shaft to the golf club head is aligned to intersect as close as possible the center of gravity of the golf club head.

7. A low center of gravity golf club shaft according to claim 6, wherein the club attachment end of the shaft is covered with a ferrule and inserted within the socket.

8. A low center of gravity golf club according to claim 1, wherein the top of the club head defines a socket into which the club attachment end of the shaft covered with a lightweight, recessed, cushioned ferrule is inserted therein.

9. A low center of gravity golf club according to claim 1, wherein the shaft has walls defining a hollow interior.

10. A low center of gravity golf club according to claim 1, wherein the shaft is cone-like shaped.

11. A low center of gravity golf club according to claim 1, wherein the golf club head has a sole comprising a single piece sole plate covering the bottom of the golf club head defining:

i. a central air channel groove, said central air channel groove having an inlet underneath and approximately in normal alignment with the face of the golf club head and running approximately one half the width of the sole to provide a support base for the club head, and ii. said central air channel groove leading into an angled fan shaped air exhaust flow channel exiting the rear of the club head having two angled winged flow segments on each side of the central air channel groove and angled toward the top of the club head to minimize aerodynamic resistance.

12. A low center of gravity golf club according to claim 11, wherein the top of the golf club head has an angled socket positioned behind the club face and toward the center of the club head into which the end of the shaft is inserted and attached to the sole plate to align the shaft to pass near the center of gravity of the club head.

13. A method for constructing a low center of gravity golf club comprising:

a. constructing a lightweight golf club head or iron having a toe, heel, elevated club face, sole, and top, b. attaching a hollow tapered shaft with a smaller attachment club end to the top of the club head proximate the heel such that the angle of attachment of the shaft to the club head is aligned to intersect as close as possible the center of gravity of the club head, and a handle end having an outer diameter sized to fit and provide a desired sized grip for a user; the shaft made of filament wound or prepreg tape graphite built up to form three separated tapered increased diameter nodes along the shaft:

i. a torque control node positioned near the club head to minimize torque caused by a miss-hit shot, ii. a kick-point control tapered node located along the lower one half of the shaft toward the attachment club end to allow the shaft to flex at a pre-selected point between the torque control node and the kick-point control node to adjust the angle the club face strikes a golf ball to provide the optimal shot distance at the desired loft, and minimize shaft torque, and iii. a vibration control node located proximate the handle to absorb and dampen vibration of the shaft when a ball is struck, and c. attaching a handle, which does not materially increase the weight of the handle end to provide a handgrip.

* * * * *